US011584145B2

(12) United States Patent
Anderson

(10) Patent No.: US 11,584,145 B2
(45) Date of Patent: Feb. 21, 2023

(54) TENSION ADJUSTMENTS IN PRINTERS TO PREVENT SLIPPING

(71) Applicant: Hewlett-Packard Development Company, L.P., Spring, TX (US)

(72) Inventor: Ronald R. Anderson, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/255,669

(22) PCT Filed: Feb. 5, 2019

(86) PCT No.: PCT/US2019/016626
§ 371 (c)(1),
(2) Date: Dec. 23, 2020

(87) PCT Pub. No.: WO2020/162881
PCT Pub. Date: Aug. 13, 2020

(65) Prior Publication Data

US 2021/0362523 A1 Nov. 25, 2021

(51) Int. Cl.

| | |
|---|---|
| ***B41J 2/01*** | (2006.01) |
| ***B41J 15/16*** | (2006.01) |
| ***B41J 15/04*** | (2006.01) |
| *B41J 11/00* | (2006.01) |

(52) U.S. Cl.
CPC ..... *B41J 15/16* (2013.01); *B41J 15/04* (2013.01); *B41J 11/002* (2013.01)

(58) Field of Classification Search
None
See application file for complete search history.

(56) References Cited

U.S. PATENT DOCUMENTS

| | | | |
|---|---|---|---|
| 2,949,295 | A | 8/1960 | Huck |
| 4,796,066 | A | 1/1989 | Morris et al. |
| 5,812,151 | A | 9/1998 | Kishine et al. |
| 5,987,299 | A | 11/1999 | Kopp et al. |

(Continued)

FOREIGN PATENT DOCUMENTS

| | | | |
|---|---|---|---|
| CN | 102381028 | A | 3/2012 |
| CN | 104070837 | A | 10/2014 |
| DE | 19630318 | | 7/1998 |

*Primary Examiner* — Erica S Lin
*Assistant Examiner* — Tracey M McMillion

(57) ABSTRACT

In example implementations, a printing device is provided. The printing device includes a printer module, a first driver roller, and a second drive roller. The printer module includes a single set of print bars. A first side of the single set of print bars is to print on a first side of a continuous web of print media and a second side of the single set of print bars is to print on a second side of the continuous web of print media. The continuous web of print media travels over a common set of idler rollers. The first driver roller is to control an amount of tension of the continuous web of print media on a first side. The second drive roller is to control an amount of tension of the continuous web of print media on a second side. The amount of tension of the continuous web of print media on the second side is greater than the amount of tension of the continuous web of print media on the first side.

6 Claims, 5 Drawing Sheets

(56) References Cited

U.S. PATENT DOCUMENTS

| | | | | |
|---|---|---|---|---|
| 5,996,491 | A | 12/1999 | Kishine et al. | |
| 2010/0230527 | A1 | 9/2010 | Ray | |
| 2012/0050363 | A1 | 3/2012 | Nagashima | |
| 2012/0201491 | A1 | 8/2012 | Zhou | |
| 2012/0201591 | A1* | 8/2012 | Leighton | B41J 15/165 400/618 |
| 2014/0023421 | A1 | 1/2014 | Leighton et al. | |
| 2014/0232776 | A1* | 8/2014 | Niertit | B41J 15/16 347/16 |

* cited by examiner

TENSION ADJUSTMENTS IN PRINTERS TO PREVENT SLIPPING

BACKGROUND

Print devices can be used to print images or text onto print media. Print devices can come in a variety of different forms and use different types of ink. For example, some print devices may be multi-function devices that can provide different functions include fax, copy, print, and the like. Some print devices may use jetted ink, toner cartridges, and the like.

Some print devices may be capable of printing on both sides of a print media. For example, the printer may have a paper path that flips the print media. The print device may then print an image or ink on the opposite side of the print media.

DETAILED DESCRIPTION

Examples described herein provide a device and method for adjusting an amount of tension of a print media in a side-by-side print device. In some print applications, large continuous webs of print media may be fed to a printing device. To print on both sides of the continuous web of print media, the print media may travel over two different sets of printheads.

When an image is printed onto one side (e.g., side A in a side-by-side printer) of the print media and dried, the print media may slightly shrink. As a result, when the print media is flipped and fed to a second side (e.g., side B in the side-by-side printer) in the side-by-side print device, the second side may have a different amount of tension. The bottom side of the print media on side B may have the printed image that was printed when the print media was processed on side A. However, the different amount of tension may cause the bottom side of side B to slip against the idler rollers. The slipping can scuff the printed image on the bottom side of the print media on side B causing print quality issues.

The present disclosure prevents slippage on the bottom side of the print media on side B by adjusting the tension in a driver roller that controls side B. In one example, the amount of tension on side B may be increased to increase a contact force of the print media to the idler rollers. The increased contact force may prevent the bottom side of the print media on side B from slipping. As a result, scuffing of the printed image on the bottom side of the print media may be avoided.

Increasing the tension on side B may cause the print media to move more slowly in side A. The slower speed may cause some slipping on a bottom side of the print media on side A. However, since there is no ink on the bottom side of the print media on side A, the slipping may not cause print quality issues.

Figure 1:
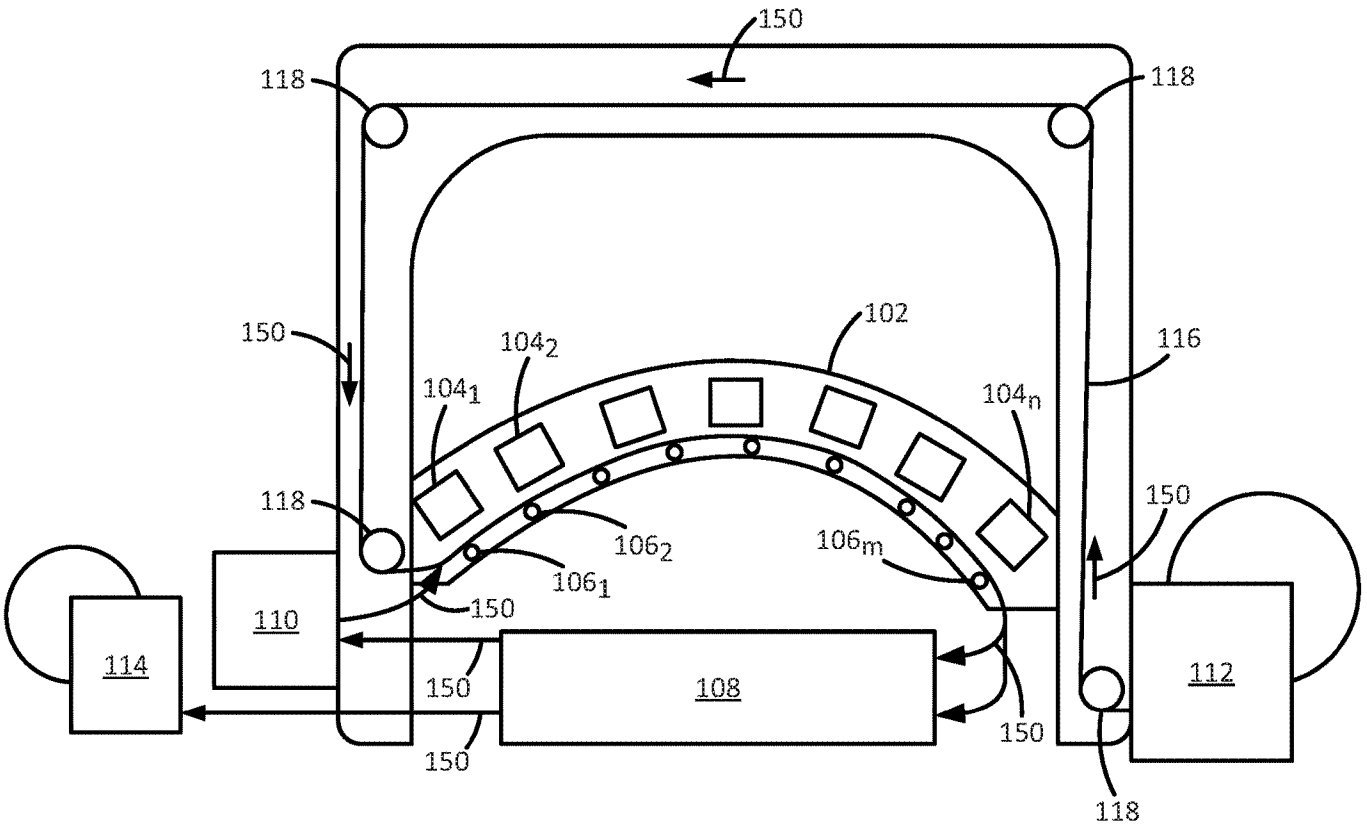
FIG. 1 is a block diagram of a side view of an example printing device of the present disclosure.

FIG. 1 illustrates an example printing device 100 of the present disclosure. In one example, the printing device 100 may include a print module 102, a dryer module 108, and a turnbar module 110. In one example, a feed 112 may provide a continuous web of print media 116 through the printing device 100. A collector 114 may collect the continuous web of print media 116 after a print job on the continuous web of print media 116 is complete.

In one example, the continuous web of print media 116 may be fed to the print module 102. The continuous web of print media 116 may be print media, such as paper. The continuous web of print media 116 may be a continuous roll of paper. In other words, the paper is not cut sheets that may be placed in a paper tray and individually printed.

In one example, the print module 102 may include a single set of print bars $\mathbf{104}_1$ to $\mathbf{104}_n$ (hereinafter also referred to collectively as print bars 104). The print bars 104 may be located over a plurality of rotating idlers or non-rotating bars $\mathbf{106}_1$ to $\mathbf{106}_m$ (hereinafter also referred to collectively as idlers 106).

In one example, each print bar 104 may include two independently controllable sets of printheads. Each set of printheads may be used to print on one of the sides of the continuous web of print media 116.

A width of the print bars 104 and the idlers 106 may be wide enough to accommodate two separate paths of the continuous web of print media 116 (illustrated in FIG. 2 and discussed below). For example, if the continuous web of print media 116 has a width of 24 inches, the width of the print bars 104 and the idlers 106 may be at least 48 inches, or slightly larger than 48 inches.

In one example, the print bars 104 and the idlers 106 may be arranged along an arched path. The arched path may help to ensure that the continuous web of print media 116 stays flat against the idlers 106. In one example, the print bars 104 and the idlers 106 may be arranged in flat plane or straight line. However, in such an arrangement a vacuum may be included to suck the continuous web of print media 116 against the idlers 106 or a flat platen.

In one example, the print module 102 may include drive rollers 118. The drive rollers 118 may be located in various locations in the print module 102. For example, the drive rollers 118 may be located after the feed 112, towards a top of the printing device 100 over the print module 102, before the print module 102, after the print module 102, and the like. The drive rollers 118 may be located in additional locations that are not shown, e.g., after the dryer module 108.

In one example, the drive rollers 118 may control an amount of tension that is applied to the continuous web of print media 116. As discussed above, the amount of tension may be based on a speed of rotation of the drive rollers 118. When the drive rollers are driven at a higher speed than the continuous web of print media 116 is traveling, the mismatch may cause a side of the continuous web of print media 116 in contact with the idler rollers 106 to slip against the idler rollers 106. If there is ink on the side of the continuous web of print media 116 in contact with the idler rollers 106, the slipping can cause defects or print quality issues.

Figure 2:
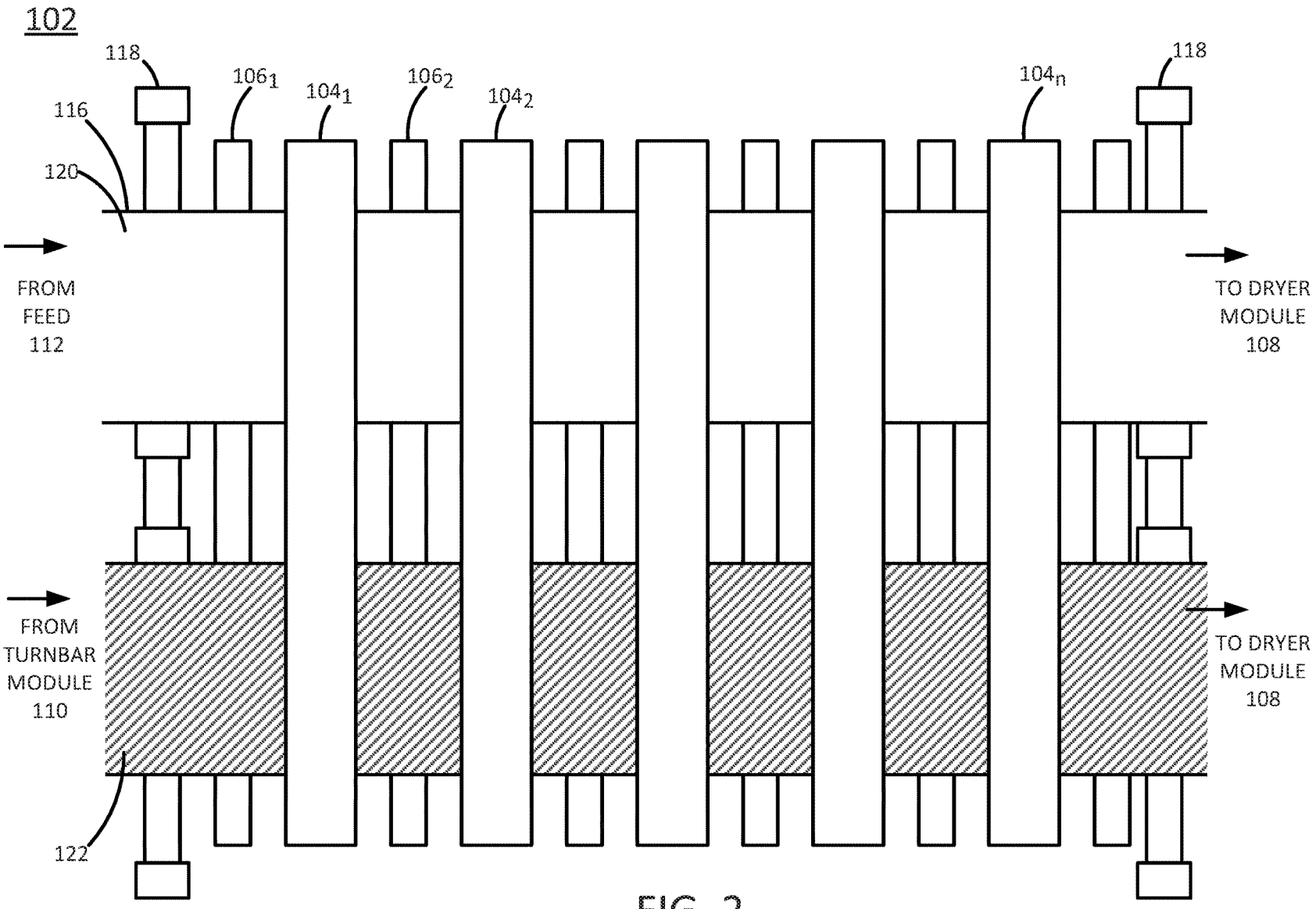
FIG. 2 is a block diagram of a top view of an example print module of the printing device of the present disclosure.

FIG. 2 illustrates a top view of an example of the print module 102 of the present disclosure. FIG. 2 illustrates how the continuous web of print media 116 travels in a side-by-side path in the print module 102. For example, the continuous web of print media 116 may travel along a first side, or left side, from the feed 112 over the drive roller 118 and the idler rollers 106. A first side of the print bars 104 may print on a first side 120 (also referred to as a front side) of the continuous web of print media 116. For example, the print bars 104 may print an image, text, graphics, and the like, associated with a print job on the first side 120 of the continuous web of print media 116.

The continuous web of print media 116 may then continue to the dryer module 108. Referring back to FIG. 1, after printing on the first side 120, the continuous web of print media 116 may be fed to the dryer module 108. Although a single dryer module 108 is illustrated in FIG. 1, it should be noted that any number of dryer modules 108 may be deployed. For example, the printing device 100 may include two or more dryer modules 108.

In one example, the dryer module(s) 108 may provide heat or air to dry the printing material or the printing fluid that is dispensed onto the first side 120 of the continuous web of print media 116. In one example, the dryer module 108 may include a paper path that returns the continuous web of print media 116 below the print module 102 and back to the turnbar module 110.

In one example, the turnbar module 110 may flip or turn over the continuous web of print media 116. The turnbar module 110 may include any type of mechanism that may flip the continuous web of print media 116. In one example, the turnbar module 110 may include a set of diagonal air bars that may flip the continuous web of print media 116 and turn the continuous web of print media 116 180 degrees back towards the print module 102.

In one example, after the turnbar module 110, a second side 122 of the continuous web of print media 116 may be fed to the print module 102. FIG. 2 illustrates how the second side 122 of the continuous web of print media 116 is fed on a right side of the print module 102. A second set of printheads of the print bars 104 may print an image, text, graphics, and the like, associated with a print job on the second side 122 of the continuous web of print media 116.

The bottom side (e.g., the first side 120) of the continuous web of print media 116 moving along the right side, or the second side, of the print module 102, may have ink dispensed from the first side of the print bars 104. As noted above, if the bottom side of the continuous web of print media 116 traveling along the right side slips against the idler rollers 106, the ink may smear or be scuffed causing print quality issues. This may occur when a portion of the continuous web of print media 116 shrinks after passing through the dryer module 108.

For example, the portion of the continuous web of print media 116 traveling along the right side may be shrunk after being dried in the dryer module 108. As a result, the portion of the continuous web of print media 116 traveling along the right side may move more slowly than the portion of the continuous web of print media 116 traveling along the left side. Since the idler rollers 106 are shared by both the first side and the second side of the print module 102, the idler rollers 106 may move at the higher speed of the continuous web of print media 116 traveling on the right side. The slower speed associated with the portion of the continuous web of print media 116 on the right side due to shrinking combined with the higher speed of rotation of the idler rollers 106 may cause the bottom side (e.g., the front side 120 on the right side of the print module 102) of the continuous web of print media 116 to slip against the idler rollers 106.

In one example, the area between the two drive rollers 118 may be referred to as a tension zone. The speed of the drive rollers 118 may be adjusted in a tension zone to increase an amount tension of the portion of the continuous web of print media 116 travelling on the second side of the print module 102. In one example, the drive roller 118 that is downstream (e.g., a side exiting the print module 102) may be adjusted to adjust an amount of tension on the portion of the continuous web of print media 116 traveling on the second side of the print module 102.

Increasing the amount of tension may cause the portion of the continuous web of print media 116 on the second side of the print module 102 to move faster than the portion of the continuous web of print media 116 on the first side of the print module 102. Increasing the amount of tension may also generate an amount of contact force between the bottom side of the continuous web of print media 116 traveling on the second side of the print module 102 and a common set of idler rollers 106 shared with the portion of the continuous web of print media 116 traveling on the first side of the print module 102.

Thus, adjusting the amount of tension via the drive roller 118 may prevent slipping. As a result, the print quality issues can be avoided by ensuring that the bottom side of the continuous web of print media 116 traveling on the second side of the print module 102 does not slip against the idler rollers 106.

However, the bottom side of the continuous web of print media 116 traveling on the first side of the print module 102 may be moving more slowly than the speed of the idler rollers 106. This may cause the bottom side of the continuous web of print media 116 traveling on the first side of the print module 102 to slip against the idler rollers 106. Since the bottom side of the continuous web of print media 116 traveling on the first side of the print module 102 does not have any ink, the slipping may not cause any print quality issues.

As can also be seen in FIG. 2, the print module 102 may print on the first or front side 120 and the second or back side 122 of the continuous web of print media 116 simultaneously. Said another way, the print module 102 may provide side-by-side two-sided printing for the continuous web of print media 116. For example, while the print module 102 is printing on the second side 122 of the continuous web of print media 116, the print module 102 may also print on the first side 120 of a different portion of the continuous web of print media 116.

After the print module 102 prints on the second side 122 of the continuous web of print media 116, the second side 122 may be fed through the dryer 108. The continuous web of print media 116 may then be collected by the collector 114. An example of the paper path is illustrated in FIG. 1 and shown by arrows 150.

It should be noted that the printing device 100 has been simplified for ease of explanation. The printing device 100 may include additional components that are not shown in FIG. 1. For example, the printing device 100 may have a controller to control operation of the drive rollers 118, the print bars 104, a reservoir to store print material that is dispensed by the print bars 104, input/output devices, and the like.

Figure 3:
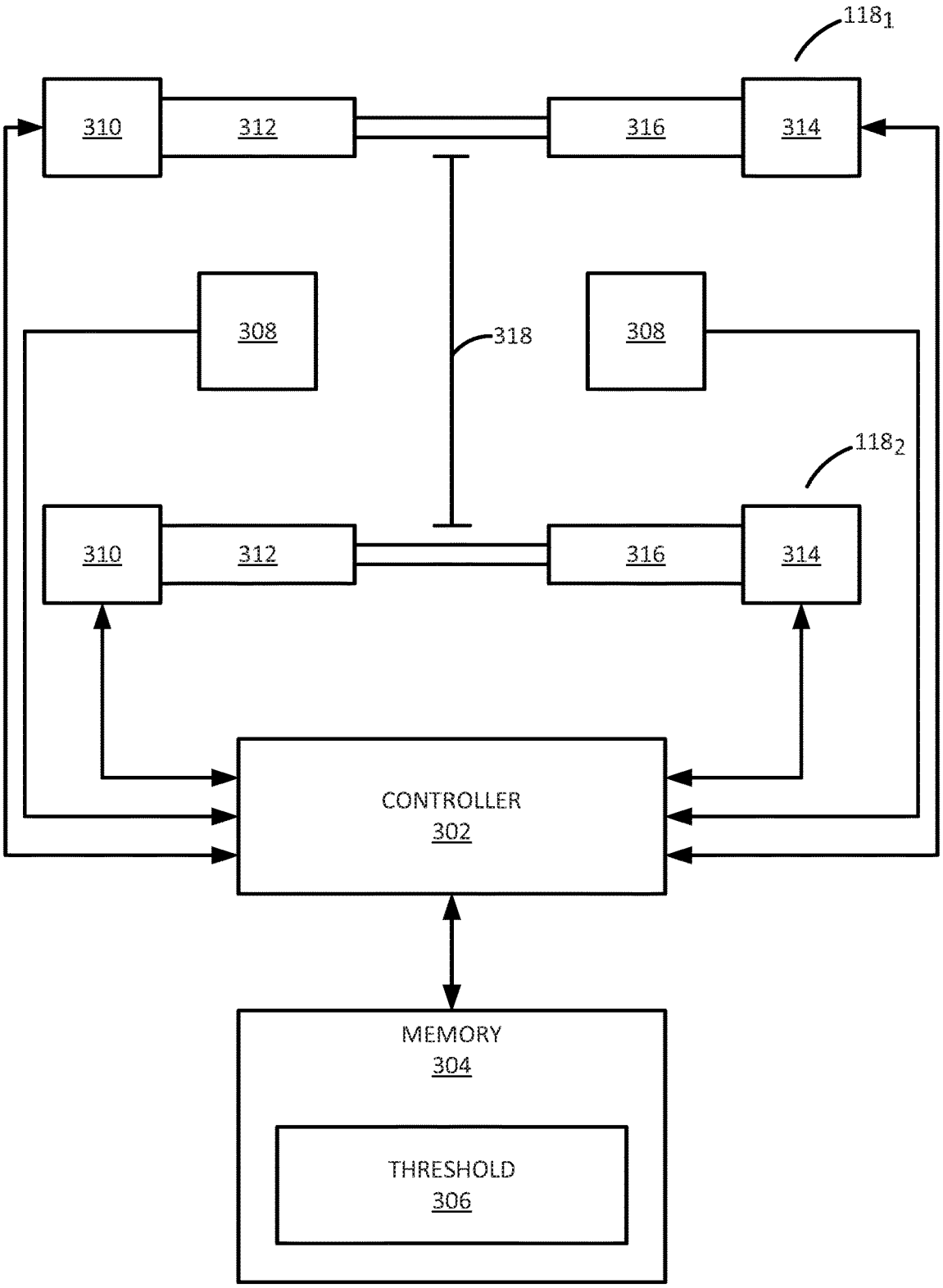
FIG. 3 is a block diagram of a top view of an example of driver rollers that can adjust an amount of tension to prevent slipping of the present disclosure.

FIG. 3 illustrates a block diagram of a top view of example drive rollers 118 of the present disclosure that can adjust an amount of tension in the continuous web of print media 116 to prevent slipping. It should be noted that FIG.

3 has been simplified for ease of explanation. For example, the idler rollers 106, the print bars 104, and the like are not shown.

In one example, the driver rollers $\mathbf{118}_1$ and $\mathbf{118}_2$ can be located at opposite ends of a tension zone 318, as described above. The print device 100 may include tension zones 318 along a paper path. The example of the drive rollers $\mathbf{118}_1$ and $\mathbf{118}_2$ illustrated in FIG. 3 may be applicable for any tension zone 318 along the paper path in the print device 100.

In one example, the drive rollers $\mathbf{118}_1$ and $\mathbf{118}_2$ may each include a motor 310 coupled to a first drive roller end 312 of the drive roller 118 and a motor 314 coupled to a second drive roller end 316 of the drive roller 118. The motor 310 may control a rotational speed of the first drive roller end 312 and the motor 314 may control a rotational speed of the second drive roller end 316.

In one example, the first drive roller end 312 of the drive rollers $\mathbf{118}_1$ and $\mathbf{118}_2$ may be associated with the first side 120 of the continuous web of print media 116 and the second drive roller end 316 of the drive rollers $\mathbf{118}_1$ and $\mathbf{118}_2$ may be associated with the second side 122 of the continuous web of print media 116. In other words, the continuous web of print media 116 may travel over the first drive roller end 312 of the drive rollers $\mathbf{118}_1$ and $\mathbf{118}_2$ to print on the first side 120 and travel over the second drive roller end 316 of the driver rollers $\mathbf{118}_1$ and $\mathbf{118}_2$ to print on the second side 122. Although the first drive roller end 312 and the second drive roller end 316 share a common axis the first drive roller end 312 and the second drive roller end 316 may be driven independently via the respective motors 310 and 314.

As described above, increasing the rotational speed of the first drive roller end 312 or the second drive roller end 316 may increase an amount of tension that is applied to the portion of the continuous web of print media 116 that travels over the first drive roller end 312 or the second drive roller end 316. Increasing the amount of tension that is applied may increase the amount of contact force between the portion of the continuous web of print media 116 and the idler rollers 106 to prevent slipping.

In one example, a load cell 308 or sensor may be located between the first drive roller end 312 of the drive rollers $\mathbf{118}_1$ and $\mathbf{118}_2$ and the second drive roller end 316 of the drive rollers $\mathbf{118}_1$ and $\mathbf{118}_2$. In other words, in a tension zone 318, two load cells 308 may be deployed for each side. The load cell 308 may be deployed as part of the idler rollers 106 or may be a separate component in the tension zone 318.

The load cell 308 may measure an amount of tension (e.g., measured in pounds per square foot (lbs/ft$^2$)) in the continuous web of print media 116 that travels over the load cell 308. The motors 310 and 314 can be controlled based on the amount of tension measured by the load cell 308.

In one example, the print device 100 may include a controller 302 and a memory 304. The memory 304 may be a non-transitory computer readable storage medium. The controller 302 may be communicatively coupled to the memory 304, the load cell 308, and the motors 310 and 314 of the drive rollers $\mathbf{118}_1$ and $\mathbf{118}_2$. The controller 302 may be a processor or an application specific integrated circuit (ASIC) chip.

In one example, the controller 302 may adjust a speed of the first drive roller end 312 and/or the second drive roller end 316 of the drive rollers $\mathbf{118}_1$ and $\mathbf{118}_2$ by controlling the motors 310 and 314. In one example, the controller 302 may control the downstream drive roller (e.g., the drive roller $\mathbf{118}_1$).

In one example, the controller 302 may receive a measurement of an amount of tension from the load cell 308. The measurement of the amount of tension may be compared to a threshold 306 stored in the memory 304. The threshold 306 may be a user defined threshold for a desired amount of tension, or a set operational speed of the continuous web of print media 116, over the first drive roller end 312 and/or over the second drive roller end 316.

In one example, the controller 302 may automatically increase the amount of tension over the second drive roller end 316 (e.g., the second side 122) to ensure that the bottom side of the second side 122 of the continuous web of print media 116 does not slip against the idler rollers 106. For example, the user defined threshold 306 may be 20 lbs/ft$^2$ for both the first drive roller end 312 and the second drive roller end 316. However, the controller 302 may set the threshold for the second drive roller end 316 to be 20% higher (e.g., 24 lbs/ft$^2$).

In one example, controller 302 may compare the measured amount of tension to the threshold 306. Based on the comparison, the controller 302 may control the motor 310 and/or 314 to adjust a speed of the first drive roller end 312 and/or the second drive roller end 316. Adjusting the rotational speed of the first drive roller end 312 and/or the second drive roller end 316 may cause the amount of tension to increase or decrease, accordingly.

For example, the load cell 308 may measure an amount of tension on the second drive roller end 316. The controller 302 may compare the amount of tension that is measured to the threshold 306 to determine that the measured amount of tension is below the threshold. In response, the controller 302 may increase the power to the motor 314 to cause the second drive roller end 316 to rotate faster. In one example, the controller 302 may execute a feedback loop until the measured amount of tension is above the threshold 306.

In one example, the controller 302 may compare the amount of tension measured by the load cell 308 on the first drive roller end 312 to the amount of tension measured by the load cell 308 on the second drive roller end 316. As noted above, the controller 302 may control the motors 310 and 314 such that the amount of tension on the second drive roller end 316 is greater than the amount of tension on the first drive roller end 312 to prevent slipping. If the measured amount of tension is greater on the first drive roller end 312 than the second drive roller end 316, then the controller 302 may adjust the power to the motors 310 and/or 314 such that the amount of tension on the second drive roller end 316 is greater than the amount of tension on the first drive roller end 312. For example, the amount of power to the motor 310 may be reduced, the amount of power to the motor 314 may be increased, or both.

Figure 4:
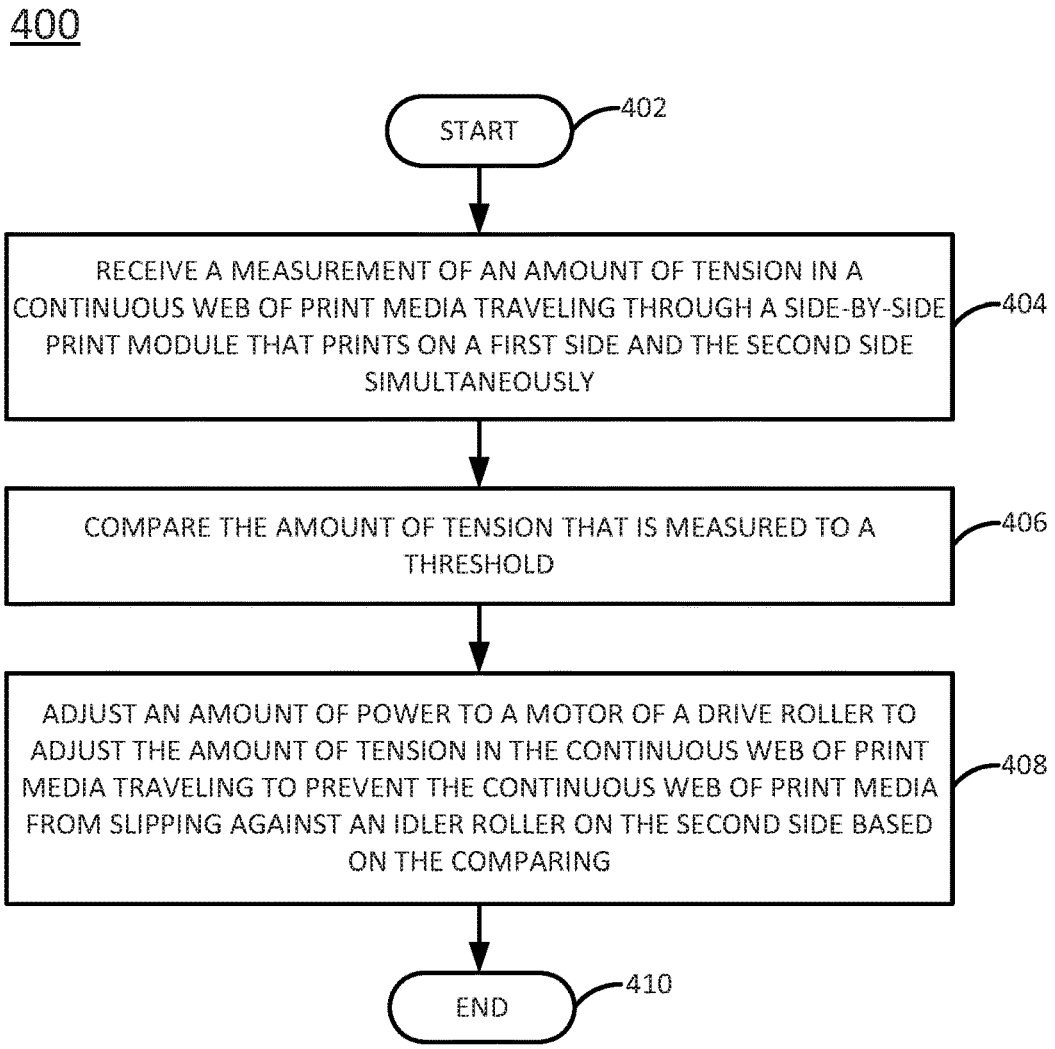
FIG. 4 is a flow chart of an example method for adjusting a tension in a drive roller to prevent slipping of the present disclosure.

FIG. 4 illustrates a flow diagram of an example method 400 for adjusting a tension in a drive roller to prevent slipping. In an example, the method 400 may be performed by the printing device 100.

At block 402, the method 400 begins. At block 404, the method 400 receives a measurement of an amount of tension in a continuous web of print media traveling through a side-by-side print module that prints on a first side and the second side simultaneously. For example, the amount of tension may be measured by a load cell. The load cell maybe part of the idler rollers that the continuous web of print media travel across in the side-by-side print module.

In one example, each side of the side-by-side module may have a respective load cell. In other words, a first side may have a first load cell and a second side may have a second load cell. The first load cell may measure an amount of tension in a first portion of the continuous web of print media travelling through the first side of the side-by-side print module. The second load cell may measure an amount of tension in a second portion of the continuous web of print media travelling through the second side of the side-by-side print module.

At block 406, the method 400 compares the amount of tension that is measured to a threshold. In one example, the amount of tension that is measured may be of the second portion of the continuous web of print media travelling through the second side of the side-by-side print module. The threshold may be a desired amount of tension in the continuous web of print media to prevent slipping against the idler rollers on the second side of the side-by-side print module.

In one example, the amount of tension that is measured may be for both the first side and the second side of the side-by-side print module. The amount of tension on the first side and the second side that is measured may both be compared to the threshold. In addition, the controller may compare the amount of tension that is measured on the first side to the amount of tension that is measured on the second side. The controller may perform the comparison to ensure that the amounts of tension that are measured in both the first side and the second side are above the desired threshold and also that the amounts of tension measured on the second side is greater than the amount of tension measured on the second side.

As discussed, above, the second drive roller may be set to a higher amount of tension to ensure that the image printed on the first side of the continuous web of print media that is now the bottom side when travelling along the second side of the side-by-side print module does not slip against a common set of idler rollers. The second portion of the continuous web of print media that travels along the second side may shrink after being processed by a dryer module. Thus, without setting the amount of tension on the second driver roller higher than the amount of tension on the first drive roller, the bottom side (e.g., the front side after being flipped) may slip against a common set of idler rollers.

At block 408, the method 400 adjusts an amount of power to a motor of a drive roller to adjust the amount of tension in the continuous web of print media traveling to prevent the continuous web of print media from slipping against an idler roller on the second side based on the comparing. In one example, the drive roller may include a first end and a second end that share a common axis, but can be independently driven by a respective motors, as described above and illustrated in FIG. 3. In other words, a first motor may be coupled to a first end of the drive roller to control an amount of tension on the first portion of the continuous web of print media travelling over the first side of the side-by-side print module. A second motor may be coupled to a second end of the drive roller to control an amount of tension on the second portion of the continuous web of print media travelling over the second side of the side-by-side print module.

In one example, the first drive roller and the second drive roller may be opposite ends of a single drive roller. For example, the drive roller may comprise a first drive roller end and a second drive roller end that share a common axis, but can be independently driven by a respective motor. An example of the driver roller is illustrated in FIG. 3 and described above.

In one example, the motor that is adjusted may be the second motor on the second end of the drive roller to ensure that the amount of tension on the second side is higher than the amount of tension on the first side. In one example, the motor that is adjusted may be both the first motor and the second motor to ensure the amounts of tension on the first side and the second side are both above the threshold.

In one example, the blocks 404, 406, and 408 may be continuously repeated as part of a feedback loop. As a result, the controller may continuously monitor the amounts of tension in the continuous web of print media on both the first side and the second side of the side-by-side print module. The controller may then perform adjustments to the motor of the drive roller based on the amounts of tension that are measured. At block 410, the method 400 ends.

Figure 5:
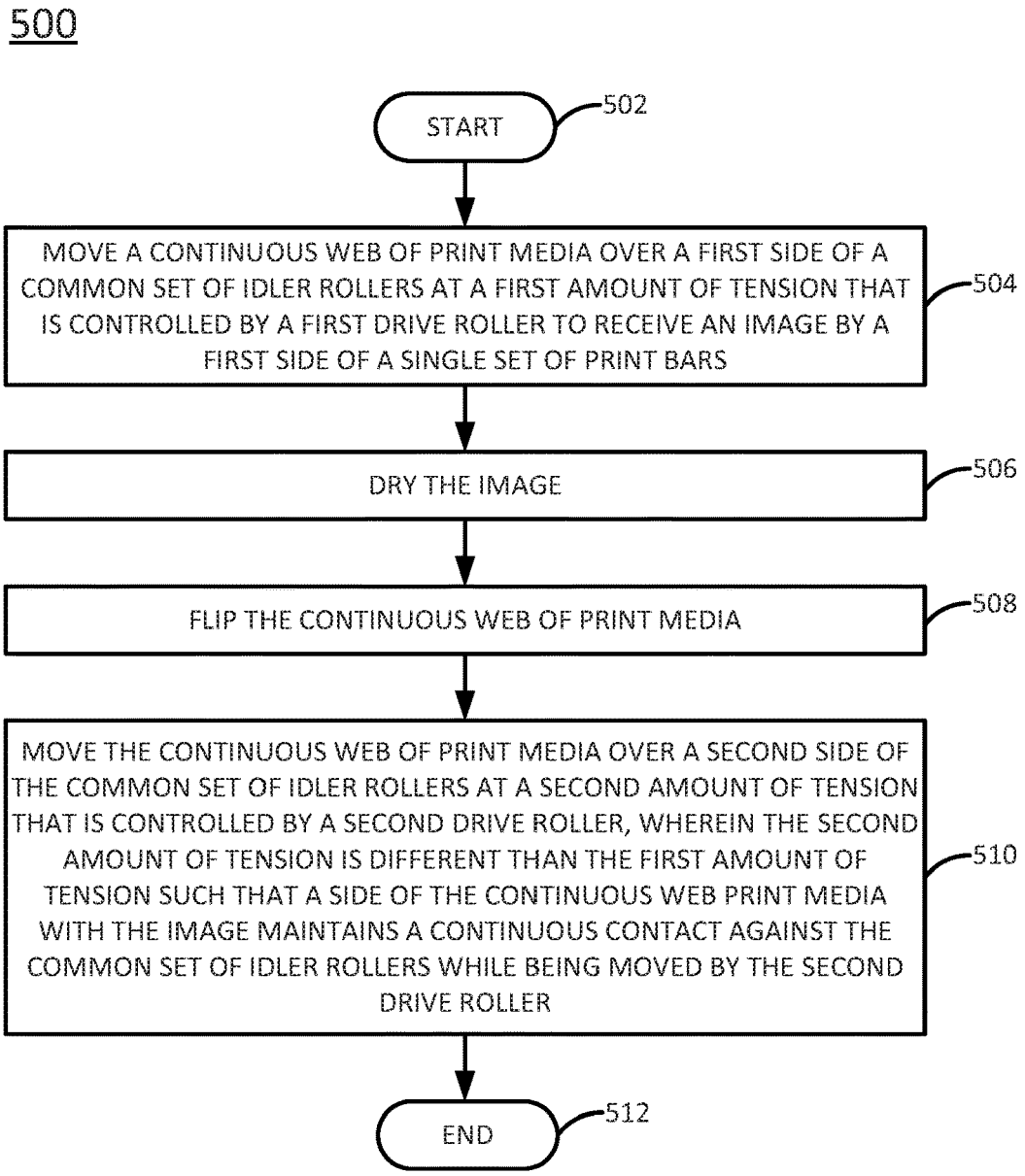
FIG. 5 is a flow chart of an example method for printing two sides of a print media with different amounts of tension of the present disclosure.

FIG. 5 illustrates a flow diagram of an example method 500 for printing two sides of a print media with different amounts of tension. In an example, the method 500 may be performed by the printing device 100.

At block 502, the method 500 begins. At block 504, the method 500 moves a continuous web of print media over a first side of a common set of idler rollers at a first amount of tension that is controlled by a first drive roller to receive an image by a first side of a single set of print bars. For example, a side-by-side printer may have a left side (e.g., the first side) and a right side (e.g., a second side). The continuous web of print media may be fed from a feeder through the first side such that printing fluid or ink is dispensed on the first side of the continuous web of print media.

At block 506, the method 500 dries the image. For example, the first side of the continuous web of print media may be fed through a dryer module to dry the printing fluid.

At block 508, the method 500 flips the continuous web of print media. For example, a turnbar module may flip the continuous web of print media. For example, the first side enters the turnbar module facing up. The turnbar module may flip the continuous web of print media such that the first side is facing down as the continuous web of print media exits the turnbar module.

In one example, the turnbar module may also rotate the continuous web of print media 180 degrees. For example, the continuous web of print media may enter the turnbar module in a first direction. The turnbar module may redirect the continuous web of print media in a second direction that is parallel to and directly opposite the first direction after flipping the continuous web of print media.

At block 510, the method 500 moves the continuous web of print media over a second side of the common set of idler rollers at a second amount of tension that is controlled by a second drive roller, wherein the second amount of tension is different than the first amount of tension such that a side of the continuous web of print media with the image maintains a continuous contact against the common set of idler rollers while being moved by the second drive roller. In one example, the second amount of tension may be greater than the first amount of tension such that the first side of the continuous web of media (which may be the bottom side as it travels over the second side of the common set of idler rollers) does not slip against the second side of the common set of idler rollers.

In one example, the amount of tension in the first drive roller and the second drive roller may be continuously or periodically measured by a load cell or sensor. A controller may automatically control the amount of tension on the first drive roller and the second driver roller based on the measured amount of tension. In one example, the amount of tension may be adjusted based on a comparison of the measured amount of tension on the first drive roller compared to the measured amount of tension on the second drive roller. For example, the amount of tension on the second drive roller should be higher than the amount of tension on the first drive roller.

In one example, the controller may automatically control the amount of tension on the first drive roller and the second drive roller based on a comparison of the measured amounts of tension to a threshold. For example, the amount of tension on the first drive roller and/or second drive roller may be increased or decreased based on the comparison to the threshold. At block 512, the method 500 ends.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A printing device, comprising:

a printer module comprising a single set of print bars, wherein a first side of the single set of print bars is to print on a first side of a continuous web of print media travelling over a first side of a common set of idler rollers such that a second side of the continuous web of print media that does not have any print material contacts the first side of the common set of idler rollers and a second side of the single set of print bars is to print on the second side of the continuous web of print media travelling over a second side of the common set of idler rollers such that the first side with the print material contacts the common set of idler rollers;

a first drive roller to control an amount of tension of the continuous web of print media on a first side; and a second drive roller to control an amount of tension of the continuous web of print media on a second side, wherein the amount of tension of the continuous web of print media on the second side is greater than the amount of tension of the continuous web of print media on the first side to create an amount of contact force to prevent the first side with the print material that contacts the second side of the common set of idler rollers from slipping.

2. The printing device, of claim 1, further comprising:

a dryer module to dry the print material that is printed onto the continuous web of print media; and a turnbar module to flip the continuous web of print media and feed the second side of the continuous web of print media over the second side of the single set of print bars.

3. The printing device of claim 2, further comprising:

a controller to control operation of the printer module, the first driver roller, the second drive roller, the dryer module, and the turnbar.

4. The printing device of claim 3, further comprising:

a first load cell to measure the amount of tension of the continuous web of print media on the first side; and a second load cell to measure the amount of tension of the continuous web of print media on the second side.

5. The printing device of claim 4, wherein the controller is to adjust a speed of the first drive roller and the second drive roller based on a threshold.

6. The printing device of claim 1, wherein the first driver roller and the second drive roller are independently controllable to set a respective amount of tension.

* * * * *